US006275995B1

(12) United States Patent
Le Gette et al.

(10) Patent No.: US 6,275,995 B1
(45) Date of Patent: Aug. 21, 2001

(54) HAND COVERING WITH REVERSIBLE CLEANING MEMBRANE

(75) Inventors: Brian E. Le Gette, Severna Park, MD (US); Ronald L. Wilson, Vienna, WV (US); George G. Clarke, Wilnette, IL (US)

(73) Assignee: Sweports Limited, Chicago, IL (US)

( * ) Notice: Subject to any disclaimer, the term of this patent is extended or adjusted under 35 U.S.C. 154(b) by 0 days.

(21) Appl. No.: 09/258,288

(22) Filed: Feb. 26, 1999

(51) Int. Cl.[7] ..... A41D 19/00

(52) U.S. Cl. ..... 2/160; 2/16; 2/161.6; 15/227

(58) Field of Search ..... 2/158, 159, 160, 2/161.3, 161.4, 161.6, 162, 163, 167, 16, 20; D2/610, 611, 617, 618, 619, 622; D29/113; 15/227

(56) References Cited

U.S. PATENT DOCUMENTS

| | | | |
|---|---|---|---|
| 1,713,065 | 5/1929 | Williams . | |
| 1,941,320 | 12/1933 | Pamplin | 15/227 |
| 2,103,455 | 12/1937 | Greenwald | 15/227 |
| 2,374,068 | 4/1945 | Baldeschwieler | 15/227 |
| 2,459,985 | 1/1949 | Woodbury | 2/161 |
| 2,550,092 | 4/1951 | Sitek | 15/227 |
| 2,651,071 | 9/1953 | Dyer et al. | 15/227 |
| 2,821,731 | 2/1958 | May | 15/227 |
| 2,880,436 | 4/1959 | Hayden | 15/118 |
| 3,151,333 | 10/1964 | Scholz | 2/161 |
| 3,643,386 | 2/1972 | Grzyll | 51/391 |
| 3,885,249 | 5/1975 | De Brabander | 2/161 |
| 4,051,572 | 10/1977 | Greenwood | 15/227 |
| 4,107,840 | 8/1978 | Kupperman et al. | 30/172 |
| 4,153,991 | 5/1979 | Kupperman et al. | 30/172 |
| 4,168,545 | 9/1979 | Kupperman et al. | 2/169 |
| 4,202,139 | 5/1980 | Hong et al. | 51/393 |
| 4,593,427 | 6/1986 | Ortolivo | 15/227 |
| 4,621,388 | 11/1986 | Ortolivo | 15/227 |
| 4,670,930 | 6/1987 | Lu | 15/118 |
| 4,953,250 | 9/1990 | Brown | 15/104.94 |
| 5,010,617 | 4/1991 | Nelson | 15/227 |
| 5,127,976 | 7/1992 | McLeish et al. | 156/242 |
| 5,134,746 | 8/1992 | William | 15/227 |
| 5,373,601 | 12/1994 | Miller | 15/118 |
| 5,441,355 | 8/1995 | Moore | 401/7 |
| 5,609,431 | 3/1997 | Carroll | 401/201 |
| 5,642,527 | 7/1997 | Savage | 2/161.8 |
| 5,765,252 | 6/1998 | Carr | 15/104.94 |
| 5,815,876 | 10/1998 | Overseth | 15/179 |
| 5,924,160 * | 7/1999 | Bradley | 15/227 |

* cited by examiner

*Primary Examiner*—John J. Calvert
*Assistant Examiner*—Katherine Moran
(74) *Attorney, Agent, or Firm*—Mayer, Brown & Platt

(57) ABSTRACT

An apparatus includes a hand covering and a membrane. The hand covering has a first side, a second side, and an opening into which a hand can be removably inserted. The membrane has a first side and a second side. The first side and the second side of the membrane include a surface adapted for cleaning. The membrane is fixedly attached to a portion of said hand covering.

21 Claims, 3 Drawing Sheets

HAND COVERING WITH REVERSIBLE CLEANING MEMBRANE

BACKGROUND OF THE INVENTION

The present invention relates generally to a hand covering. More specifically, the present invention relates to a hand covering with a fixedly attached, reversible cleaning membrane.

Several known cleaning devices consist of a glove or mitten constructed with a cleaning material. A user's hand can be inserted into the glove or mitten thereby covering the user's hand with the cleaning material. For example, U.S. Pat. No. 5,010,617 to Nelson discloses a polishing mitten where at least one surface is an absorbent material and a strap is extended around the use's wrist; one surface of the mitten can apply shoe polish and the other surface can to shine shoes. U.S. Pat. No. 4,621,388 to Ortolivo discloses a waterproof scouring glove with cleaning materials disposed on critical portions of the glove, e.g., the palm, thumb, and fingers.

Other known hand coverings each have been combined with a removably attachable cleaning cloth. For example, U.S Pat. No. 5,815,876 to Overseth discloses a gripping pad into which a hand can be inserted and a cleaning/polishing pad that can be removably attached to the gripping pad by a hook-and-loop fastener. U.S. Pat. No. 2,651,071 to Dyer et al. discloses a mitt with cleaning pads that are removably attachable using u-clip (i.e., bobby pins).

These known hand-insertable cleaning devices, however, suffer several shortcomings. First, with known hand-insertable cleaning devices that are constructed entirely of the cleaning material, some portions of the cleaning material are used less frequently (e.g., portions along the side of the device) than other portions of the cleaning material (e.g., portions near the palm); consequently, less used portions of the cleaning materials are wasted. With known hand-insertable cleaning devices that are constructed only partially of the cleaning material, additional and sometimes difficult manufacturing steps are required to construct the device.

Second, known hand-insertable cleaning devices with a removably attachable cleaning material allow the possibility that the cleaning material can be misplaced while unattached. In addition, the means for attaching the cleaning material to the hand inserted portion are not always effective because the cleaning material can be inadvertently separated from the hand-insertable device during the applied stress of cleaning.

SUMMARY OF THE INVENTION

Embodiments of the present invention address the shortcomings of the known hand-insertable cleaning devices. An apparatus includes a hand covering and a membrane. The hand covering has a first side, a second side, and an opening into which a hand can be removably inserted. The membrane has a first side and a second side. The first side and the second side of the membrane include a surface adapted for cleaning. The membrane is fixedly attached to a portion of said hand covering.

In another embodiment, a method is disclosed for reversing a membrane having a first side, a second side and a flap. The first side and the second side of the membrane are fixedly attached to a portion of at least one finger portion of a hand covering. The tips of the hand covering are brought towards a center portion of a first side of the hand covering.

The flap of the membrane is pulled over the portion of each finger portion to which the membrane is fixedly attached.

DETAILED DESCRIPTION

A hand-insertable cleaning device comprises a hand covering and a membrane. The hand covering has at least one finger portion, a first side, a second side, and an opening into which a hand can be removably inserted. The membrane has a first side and a second side. The membrane is fixedly attached to a portion of the at least one finger portion.

The term "fixedly attached" is used herein to indicate an attachment that is not separated when the membrane is pulled over the point of attachment. The membrane can be fixedly attached to a portion of the hand covering by any technique that retains the attachment while the membrane is pulled over the point of fixed attachment. For example, the membrane can be sewn or glued to the hand covering at the appropriate locations.

The particular side of the membrane facing outward from the hand covering can be reversed easily. A flap portion of the membrane not fixedly attached to the hand covering can be drawn over the point where the membrane is fixedly attached to the hand covering (e.g., the finger tips of the hand covering) and extended over the other side of the hand covering. The cleaning device can then be switched to the user's other hand, thereby allowing the membrane to face outward from the palm side of the user's hand.

Because the membrane is reversible with respect to the hand covering, the two sides of the membrane can be used. This is particularly beneficial where the two sides of the membrane have different characteristics useful for cleaning. For example, the two sides of the membrane each can have different abrasive characteristics. By attaching the membrane to the hand covering, the user's hand can be protected from the abrasiveness of the membrane while using the cleaning device.

Figure 1:
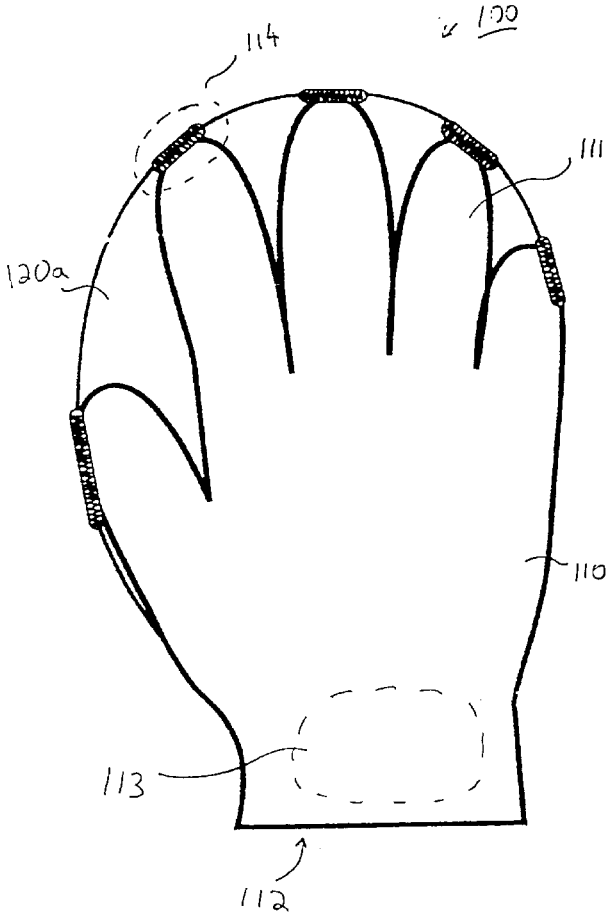
FIG. 1 illustrates a top view of a cleaning device, according to an embodiment of the present invention.
Figure 2:
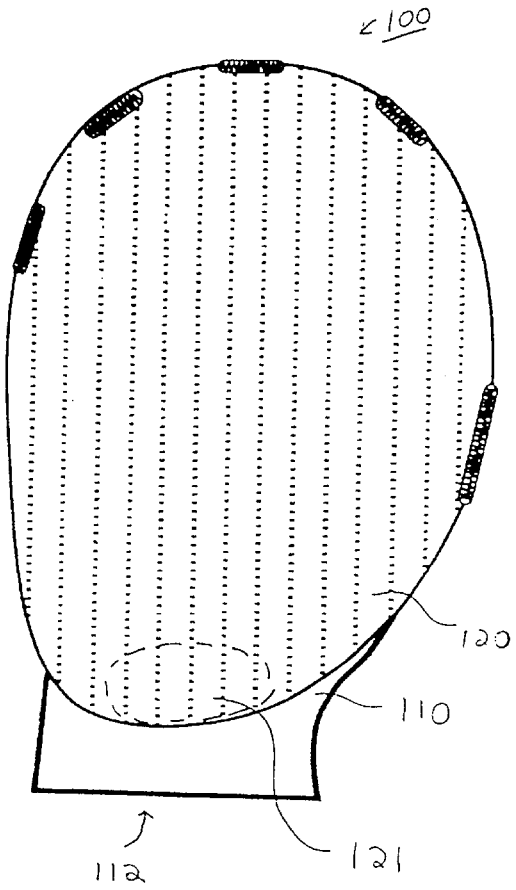
FIG. 2 illustrates a bottom view of the cleaning device shown in FIG. 1.

FIG. 1 illustrates a top view of a cleaning device, according to an embodiment of the present invention. FIG. 2 shows a bottom view of the cleaning device shown in FIG. 1. FIGS. 1 and 2 are discussed in reference to a top view and a bottom view, respectively, for convenience only. The cleaning device can be oriented in any number of ways and need not be limited to a particular orientation.

Cleaning device 100 comprises hand covering 110 and membrane 120. Hand covering 110 includes finger portions 111, an opening 112 and a wrist portion 113. Each finger portion 111 includes an outer edge portion 114 one example of which is labeled in FIG. 1. Note that the finger portions 111 correspond to a user's thumb and four fingers.

Embodiments of the present invention are not limited to a glove configuration for the hand covering. In alternative embodiments, for example, the hand covering has a mitten arrangement with fewer than five finger portions (i.e. fewer than five portions corresponding to the user's thumb and four fingers). For example, the hand covering can have a finger portion corresponding to the user's thumb and another finger portion corresponding to the user's four fingers. Also, the hand covering can have a single finger portion into which the user's thumb and fingers can be inserted.

Membrane 120 has two sides: one side is labeled in FIG. 1 as 120*a*, the other side is labeled in FIG. 2 as 120*b*. The two sides of membrane 120 can each have its own individual characteristics useful for cleaning. For example, the membrane side 120*a* shown in FIG. 1 can be less abrasive than the membrane side 120*b* shown in FIG. 2. Membrane 120 can be, for example, a cloth with different smoothness on either sides.

Figures 3, 4, 5, 6:
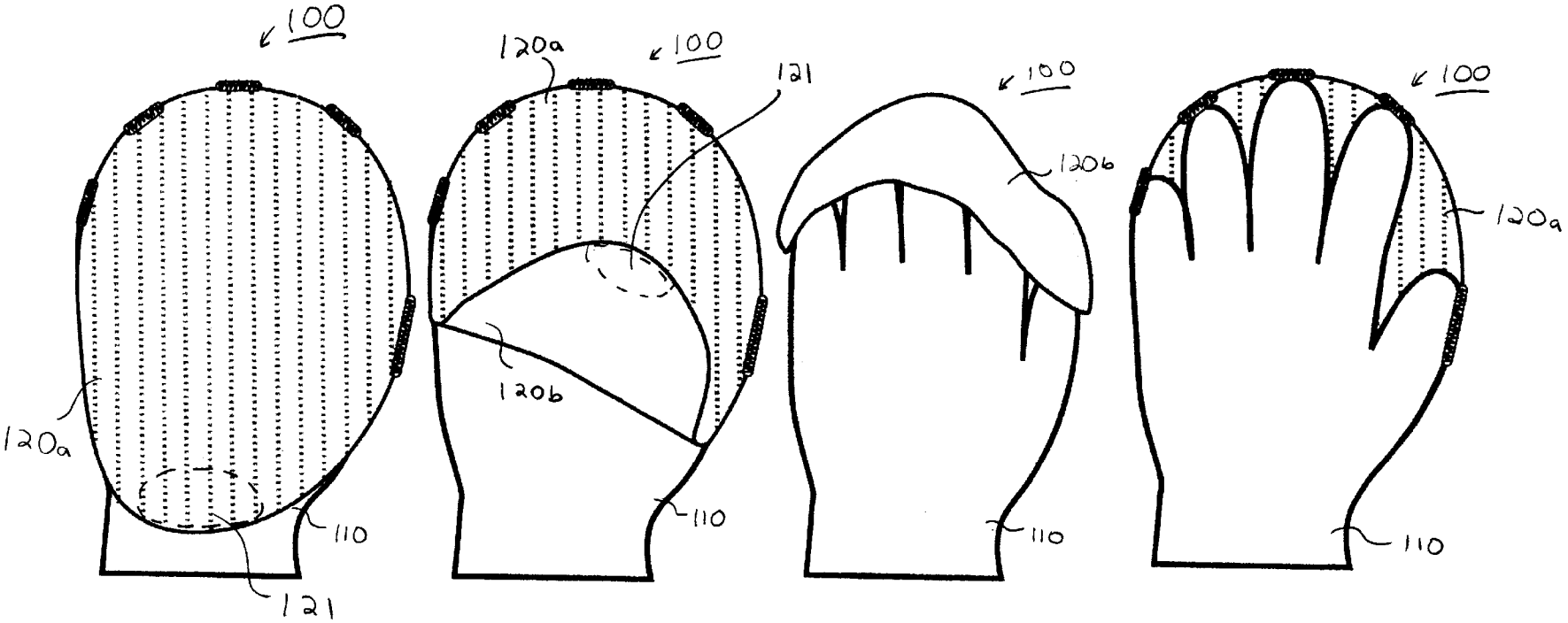
FIG. 3 illustrates a top view of the cleaning device shown in FIGS. 1 and 2 with the membrane facing outward from the hand covering.
FIGS. 4 and 5 illustrate a top view of the cleaning device shown in FIG. 3 with the membrane at intermediate positions between having one side outwardly exposed and the other side outwardly exposed.
FIG. 6 illustrates a top view of the cleaning device shown in FIG. 3 with the opposite side of the membrane being outwardly exposed.

FIGS. 3–6 illustrate a method by which the membrane can be converted from having one side exposed with respect to the hand covering to the other side being exposed. FIG. 3 illustrates a top view of the cleaning device shown in FIGS. 1 and 2 with the membrane facing outward from the hand covering. FIGS. 4 and 5 illustrate a top view of the cleaning device shown in FIG. 3 with the membrane at intermediate positions between having one side outwardly exposed and the other side outwardly exposed. FIG. 6 illustrates a top view of the cleaning device shown in FIG. 3 with the opposite side of the membrane being outwardly exposed.

As shown in FIG. 3, the cleaning device 100 has membrane side 120*a* exposed outward from hand covering 110. A flap portion 121 can be brought towards the tip of the hand covering 110 as shown in FIG. 4. Flap 121 of membrane 120 can then be pulled over the outer edge portion of the finger portions, the point(s) at which membrane 120 is fixedly attached to hand covering 110.

FIG. 5 shows the membrane 120 being pulled over the outer edge portions of hand covering 120. FIG. 6 shows the membrane 120 being fully extended to the opposite side of hand covering 120. Unlike membrane side 120*a* which was outwardly exposed in FIG. 3, the opposite side of membrane 120 (i.e., membrane side 120*b*) is outwardly exposed in the arrangement shown FIG. 6. Note the view in that FIG. 6 shows membrane side 120*a* inwardly exposed; membrane side 120*b* is outwardly exposed although not explicitly shown in FIG. 6.

Note that when one side of the membrane 120 is facing outward from hand covering 110 as shown in FIG. 3 (e.g., membrane side 120*a*), the cleaning device 100 fits on a particular hand of the users, for example, the right hand of the user. When the opposite side of membrane 120 is facing outward from hand covering 110 (e.g., membrane side 120*b*), cleaning device 100 is configured to fit on the opposite hand of the user, for example, the left hand of the user.

A user can wear a pair of cleaning devices, one cleaning device on each hand. For example, the pair of cleaning devices can be a right-handed cleaning device and a left-handed cleaning device. Matching sides of the membranes can be outwardly exposed in one arrangement; the other matching sides of the membranes can be outwardly exposed in another arrangement by reversing the membrane of each cleaning device and switching hands upon which the cleaning devices are worn.

Figure 8:
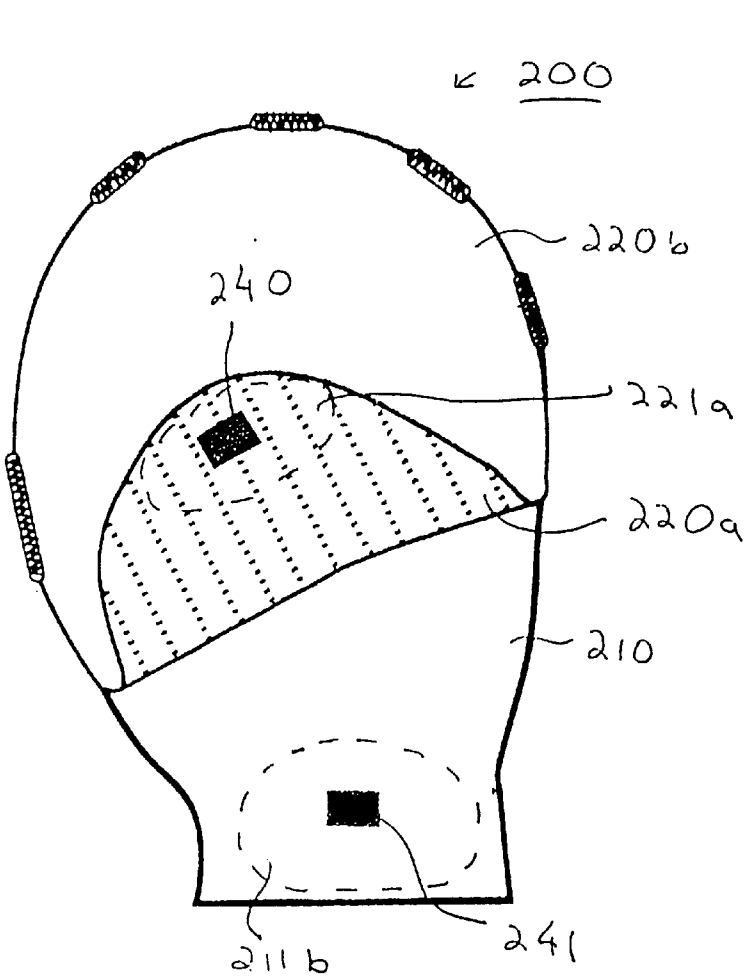
FIG. 8 illustrates a top view of the cleaning device shown in FIG. 7 where the membrane has been reversed.
Figure 7:
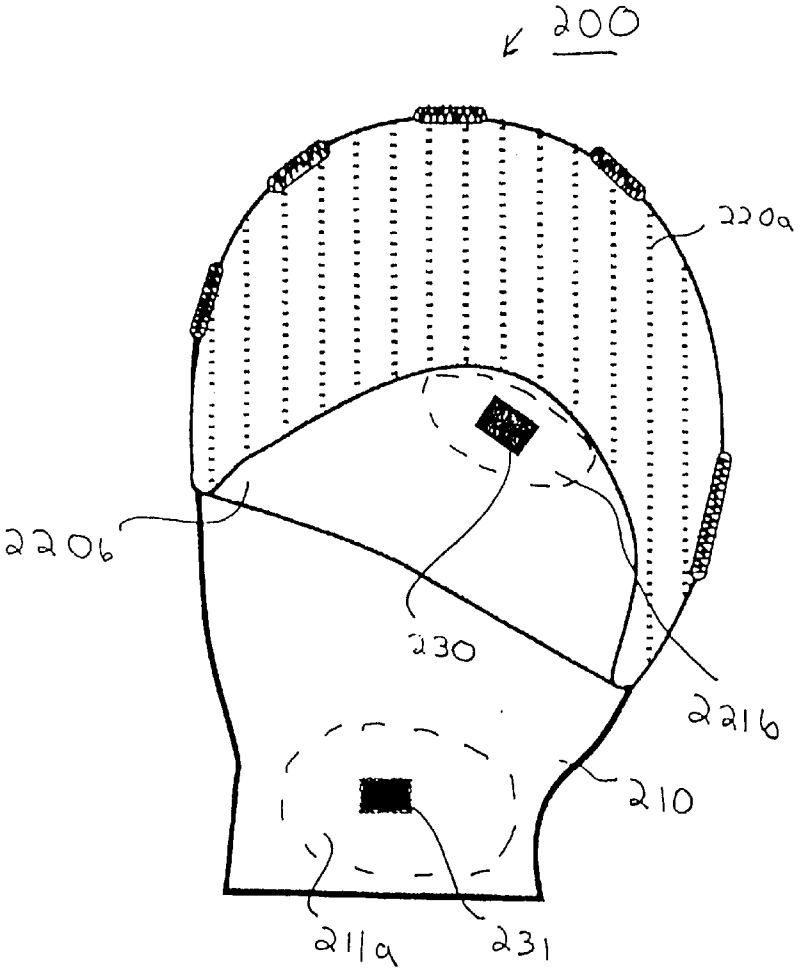
FIG. 7 illustrates a top view of a cleaning device, according to another embodiment of the present invention.

FIG. 7 illustrates a top view of a cleaning device, according to another embodiment of the present invention. FIG. 8 illustrates a top view of the cleaning device shown in FIG. 7 where the membrane has been reversed. The cleaning device shown in FIGS. 7 and 8, includes two fasteners each having one portion attached to a hand covering and another portion attached to a membrane.

The cleaning device 200 comprises a hand covering 210, a membrane 220, one set of fastener portions 230 and 231, and another set of fastener portions 240 and 241. Membrane 220 includes membrane sides 220*a* and 220*b*. Each set of fastener portions (i.e., 230 and 231; 240 and 241) can cooperate in such a manner that they are removably attachable. The fastener portions can be, for example, a hook-and-pile arrangement, a button-and-hole arrangement, or a snap set. Either set of fastener portions allow the flap portion of membrane 220 to be secured to hand covering 210 depending upon the arrangement of the cleaning device 200.

As FIG. 7 illustrates, when membrane side 220*a* is outwardly exposed, the flap portion 221*b* of membrane side 220*b* can be removably attached to the wrist portion 211*a* of hand covering via fastener portions 230 and 231. Fastener portion 230 can be fixedly attached to flap portion 221*b*; fastener portion 231 can be fixedly attached to the wrist portion 211*a* of hand covering 210. Thus, when membrane side 220*a* is outwardly exposed, fastener portion 230 can be removably attached to fastener portion 231 to secure the flap portion 221*b* to the hand covering 210.

Conversely, as FIG. 8 illustrates, when membrane side 220*b* is outwardly exposed, the flap portion 221*a* of membrane side 220*a* can be removably attached to the wrist portion 211*b* of hand covering via fastener portions 240 and 241. Fastener portion 240 can be fixedly attached to flap portion 221*a*; fastener portion 241 can be fixedly attached to the wrist portion 211*b* of hand covering 210. Thus, when membrane side 220*b* is outwardly exposed, fastener portion 240 can be removably attached to fastener portion 241 to secure the flap portion 221*a* to the hand covering 210.

It should, of course, be understood that while the present invention has been described in reference to particular configurations, other configurations should be apparent to those of ordinary skill in the art. For example, although the cleaning device was shown above with membrane being fixedly attached to the hand covering in particular locations, the membrane can be fixedly attached to the hand covering at other locations are possible. For example, the membrane can be fixedly attached to the hand covering closer to the palm away from the outer edge portion particularly where the membrane is elastic. The elasticity of the membrane combined with the locations where the membrane is fixedly attached to the hand covering allows the membrane to be reversed, thereby outwardly exposing either side of the membrane. Alternatively, the membrane can be fixedly attached at locations on the perimeter of the palm area of the hand covering.

The hand covering need not cover the entire hand. For example, the finger portions of the hand covering can be partially or completely absent from the hand covering. In such an embodiment, the membrane can be fixedly attached along the far right and far left perimeter of the palm portion of the hand covering.

What is claimed is:

1. An apparatus, comprising:

a hand covering having a first side, a second side and an opening into which a hand can be removably inserted; and a membrane having a first side and a second side, wherein at least one side of said membrane includes a surface adapted for cleaning, said membrane being fixedly attached to a portion of said hand covering, but not fixedly attached to a wrist end portion of said hand covering, wherein said apparatus comprises a first configuration when said first side of said membrane is adjacent to said first side of said hand covering, and wherein said apparatus comprises a second configuration when said second side of said membrane is adjacent to the second side of said hand covering.

2. The apparatus of claim 1, wherein said hand covering includes at least one finger portion, said membrane being fixedly attached to the least one finger portion of said hand covering.

3. The apparatus of claim 2, wherein:

said membrane is fixedly attached to an outer edge portion of the at least one finger portion.

4. The apparatus of claim 2, wherein:

said membrane is fixedly attached to each finger portion.

5. The apparatus of claim 1, further comprising:

a fastener having a first portion and a second portion, the first portion of said fastener being removably attachable to the second portion of said fastener, the first portion of said fastener being attached to a flap portion of said membrane, the second portion of said fastener being attached to a wrist portion of first side of said hand covering.

6. The apparatus of claim 1, further comprising:

a first fastener having at least a first portion and a second portion, the first portion of said first fastener being removably attachable to the second portion of said first fastener, the first portion of said first fastener being attached to a flap portion of the first side of said membrane, the second portion of said first fastener being attached to a wrist portion of the first side of said hand covering; and a second fastener having at least a first portion and a second portion, the first portion of said second fastener being removably attachable to the second portion of said second fastener, the first portion of said second fastener being attached to a flap portion of the second side of said membrane, the second portion of said second fastener being attached to a wrist portion of the second side of said hand covering.

7. The apparatus of claim 1, wherein:

the first side of said membrane has a first abrasive characteristic, and the second side of said membrane has a second abrasive characteristic.

8. The apparatus of claim 1, wherein said hand coveling is a five-fingered glove.

9. The apparatus of claim 1, wherein said hand covering is a mitten.

10. The apparatus of claim 1, wherein said membrane is permanently attached to said portion of said hand covering.

11. An apparatus comprising:

a hand covering having a plurality of finger portions, a first side, a second side and an opening into which a hand can be removably inserted; and a membrane having a first side and a second side, said membrane being fixedly attached to an outer edge portion of at least one finger portion of said hand covering and being fixedly unattached to remaining portions of said hand covering, including being fixedly unattached to a wrist end portion of said hand covering, wherein said apparatus comprises a first configuration when said first side of said membrane is adjacent to said first side of said hand covering, and wherein said apparatus comprises a second configuration when said second side of said membrane is adjacent to the second side of said hand covering.

12. The apparatus of claim 11, further comprising:

a first fastener having at least a first portion and a second portion, the first portion of said first fastener being removably attachable to the second portion of said first fastener, the first portion of said first fastener being attached to a flap portion of the first side of said membrane, the second portion of said first fastener being attached to a wrist portion of the first side of said hand covering; and a second fastener having at least a first portion and a second portion, the first portion of said second fastener being removably attachable to the second portion of said second fastener, the first portion of said second fastener being attached to a flap portion of the second side of said membrane, the second portion of said second fastener being attached to a wrist portion of the second side of said hand covering.

13. The apparatus of claim 11, wherein said membrane is permanently attached to said outer edge portion.

14. A method for reversing a membrane having a first side, a second side and a flap portion, the first side and the second side of the membrane each being a surface adapted for cleaning, the first side and the second side of the membrane being fixedly attached to a portion of at least one finger portion of a hand covering, but not fixedly attached to a wrist end portion of said hand covering said method comprising:

pulling a flap portion of the membrane, from a first side of the hand covering, over the portion of the at least one finger portion to which the membrane is fixedly attached; and extending the membrane over a second side of the hand covering.

15. The method of claim 14, further comprising:

bringing, before said pulling step, the portion of the at least one finger portion to which the membrane is fixedly attached toward a wrist portion of a first side of the hand covering.

16. The method of claim 14, wherein:

the first side of the membrane is adjacent to a first side of the hand covering before said pulling step and said extending step are performed, and the second side of the membrane is adjacent to a second side of the hand covering after said pulling step and said extending step are performed.

17. The method of claim 14, further comprising:

removably attaching a first portion of a fastener to a second portion of the fastener, the first portion of the fastener being attached to the flap portion of the membrane, the second portion of the fastener being attached to a wrist portion of the second side of the hand covering.

18. The method of claim 14, further comprising:

detaching a first portion of a first fastener from a second portion of the first fastener, the first portion of the first fastener being attached to the flap portion of the first side of the membrane, the second portion of the first fastener being attached to the wrist portion of the first side of the membrane; and removably attaching a first portion of a second fastener to a second portion of the second fastener, the first portion of the second fastener being attached to a flap portion of the second side of the membrane, the second portion of the second fastener being attached to a wrist portion of a second side of the hand covering.

19. A cleaning glove comprising:

a hand covering having a first side and a second side;

a membrane fixedly attached to a portion of said hand covering, but not fixedly attached to a wrist end portion of said hand covering;

wherein said membrane may be placed proximate said first side of said hand covering or proximate said second side of said hand covering by a user of said cleaning glove.

20. The cleaning glove of claim 19, wherein said membrane is permanently attached to said hand covering.

21. The cleaning glove of claim 19, wherein said hand covering is a five-fingered glove.

* * * * *